US009771136B2

(12) United States Patent
Grohler

(10) Patent No.: US 9,771,136 B2
(45) Date of Patent: Sep. 26, 2017

(54) MARINE OUTBOARD MOTOR TETHER

(71) Applicant: Roy John Grohler, Elizabethtown, KY (US)

(72) Inventor: Roy John Grohler, Elizabethtown, KY (US)

(73) Assignee: THE LEASH, LLC, Louisville, KY (US)

( * ) Notice: Subject to any disclaimer, the term of this patent is extended or adjusted under 35 U.S.C. 154(b) by 30 days.

(21) Appl. No.: 14/977,920

(22) Filed: Dec. 22, 2015

(65) Prior Publication Data

US 2017/0174303 A1 Jun. 22, 2017

(51) Int. Cl.
*B63H 20/10* (2006.01)
*B63H 20/02* (2006.01)

(52) U.S. Cl.
CPC ..... *B63H 20/02* (2013.01); *B63H 20/10* (2013.01); *B63H 2020/103* (2013.01)

(58) Field of Classification Search
CPC ..... B63H 2020/103; B63H 20/10
See application file for complete search history.

(56) References Cited

U.S. PATENT DOCUMENTS

| | | | | |
|---|---|---|---|---|
| 2,999,476 A | | 9/1961 | Johnson | |
| 3,416,759 A | * | 12/1968 | Arnett | B63H 20/02 248/499 |
| 3,460,506 A | | 8/1969 | Johns et al. | |
| 3,653,270 A | | 4/1972 | Bergstedt | |
| 5,609,506 A | | 3/1997 | Williams, Jr. | |
| 7,377,227 B2 | | 5/2008 | La Roche | |

OTHER PUBLICATIONS

Polson, Gary "Approaches to Prevent Outboard Motors From Flipping Into Boats After Striking Floating or Submerged Objects." Dec. 18, 2013.*
Sampson Rope Chafe Protection Solutions (catalog), Jan. 2013.*
Cortland, "Plasma Rope "Quick" Q&A", Dec. 2013.*

* cited by examiner

*Primary Examiner* — Andrew Polay
(74) *Attorney, Agent, or Firm* — Steve Witters; Witters & Associates

(57) ABSTRACT

A high strength safety tether adapted to restrain motor flipping in the event of an underwater strike between the motor and an underwater object. In one embodiment the tether is sized to generally surround the exhaust housing of the motor. The free ends of the tether are adapted to be bolted to the transom of the boat. In another embodiment a second leash is attached to a first leash so that the first leash surrounds the steering arm assembly and the second leash surrounds the exhaust housing of the motor.

3 Claims, 3 Drawing Sheets

MARINE OUTBOARD MOTOR TETHER

FIELD OF THE INVENTION

This invention relates to marine engines and more particularly to devices for the prevention of accidental flipping of outboard motors.

BACKGROUND OF THE INVENTION

Small boats, such as bass boats and the like, can be provided with fairly large outboard motors and can reach speeds of up to 100 miles per hour. These speeds are often obtained during bass fishing contests when the bass boats race to reach a preferred fishing location. Other recreational boats can similarly be equipped with outboard motors which allow them to obtain speeds in the 60 to 70 mile per hour range. At such high speed there is a danger of contact with objects just below the surface of the water such as a submerged log or other impediment often found in rivers and lakes.

Outboard motors are pivotally mounted on the transom of the boat for rotation of the drive mechanism, particularly the propeller, above the surface of the water or above the ground for towing, launching and recovering the boat. At high speed should the drive mechanism contact a submerged object, such as a log, the impact will cause the motor to violently rotate or flip and if the impact is severe enough the motor will be torn from the transom may actually be flipped into the boat. Since the motor will be running when this occurs the occupant of the boat can be fatally or seriously injured by the propeller. A listing of motor flip accidents compiled in July 2014 lists 63 motor flip accidents and reports 9 fatalities. Even if there is no injury to occupants of the boat the damage to the boat and motor is expensive and in some cases the motor does not flip into the boat but is thrown into the water resulting in the loss of an expensive motor.

SUMMARY OF THE INVENTION

The present invention relates to a high strength safety tether adapted to restrain motor flipping in the event of an underwater strike between the motor and an underwater object. In one embodiment the tether is sized to generally surround the exhaust housing of the motor. The free ends of the tether are adapted to be bolted to the transom of the boat. In another embodiment a second leash is attached to a first leash so that the first leash surrounds the steering arm assembly and the second leash surrounds the exhaust housing of the motor.

The tether may comprise a chain, cable or preferably multifilament high strength polymer fiber. In the preferred embodiment the tether is designed to prevent the motor flipping of a 750 pound outboard motor striking a submerged object at 70 miles per hour.

DESCRIPTION OF THE PREFERRED EMBODIMENT

Figure 1:
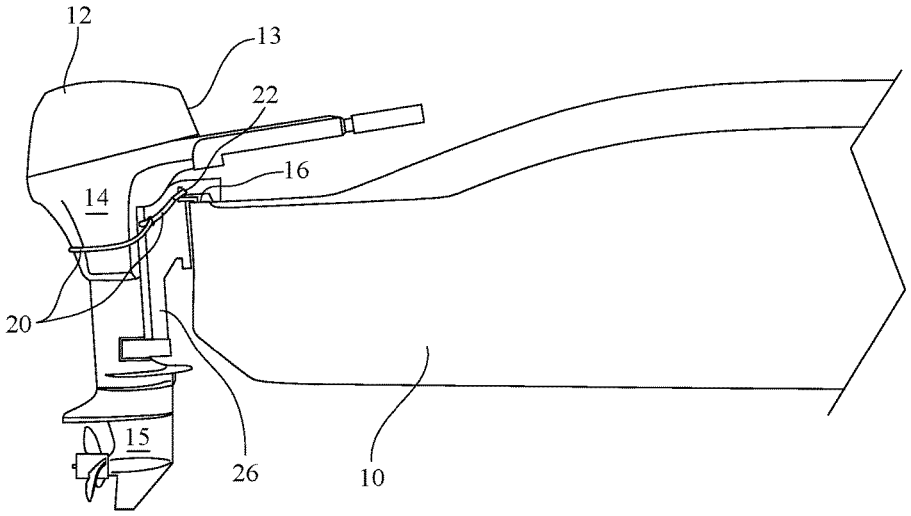
FIG. 1 is a side view partially broken away illustrating the leash tether around an outboard motor mounted on a marine vessel.

Referring to FIG. 1 a marine vessel 10, for example a bass boat, has a large multi-cylinder outboard motor 12 comprising a power head 13, the exhaust housing 14, the steering arm assembly 26 and drive section 15 including the propeller. The motor 12 is conventionally secured on the transom 16 of the vessel 10 by being directly bolted or by a suitable bracket that is bolted to the transom. The drive mechanism 15 extends slightly below the keel of the vessel 10. As is conventional, motor 12 can be tilted up either manually or electronically for travelling through shallow water where there may be propeller damaging debris. It is this pivoting action that can result in a motor flip when the drive section 15 of the motor 12 strikes a submerged object at high speed. Such a high speed strike causes the motor 12 to pivot violently tearing it off the transom 16 and flipping it into the passenger and/or driver's compartment of the vessel 10. Since the motor 12 will still be running, the passengers are subject to serious injury or even death. Even if the motor 12 is not flipped into the vessel 10 it can separate from the vessel and be lost in the water.

In accordance with the invention as shown in FIG. 1 a high strength leash tether 20 surrounds the exhaust housing 14 to prevent the flipping of the motor 12. Each free end 22 of the leash 20 is formed around a metal spool 24 (FIG. 2) for receiving a bolt for bolting the free end to the transom 16 of the vessel 10.

Figure 4:
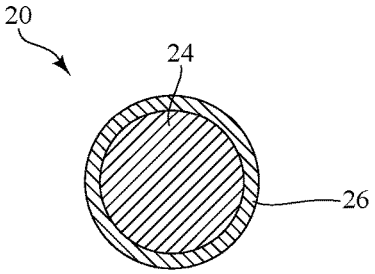
FIG. 4 is a cross sectional view of the leash tether of the invention.

Referring to FIG. 4 a preferred embodiment of the high strength leash tether 20 comprises a ½ to ¾ inch rope core 24 of multifilament yarn spun from liquid crystal polyester distributed under the trademark Vectran™ by Kuraray.Co. LTD. As illustrated, the core 24 is a 7/16 double braided rope that is capable of a tensile strength of 18,000 pounds. The core 24 is provided with a polymer coating 26 that is most conveniently applied by a heat shrinkable polyolefin tube such as SUMITUBE B2™ distributed by Heatsink.com of Ogdon, Utah. The outer coating over the core provides some rigidity for the leash so that it retains its position around the exhaust housing 14 of the motor 12 and helps to maintain the integrity of the monofilament core 24. In the event of a high impact strike the leash tether prevents the motor 12 from pivoting and avoids a motor flip accident.

Figure 2:
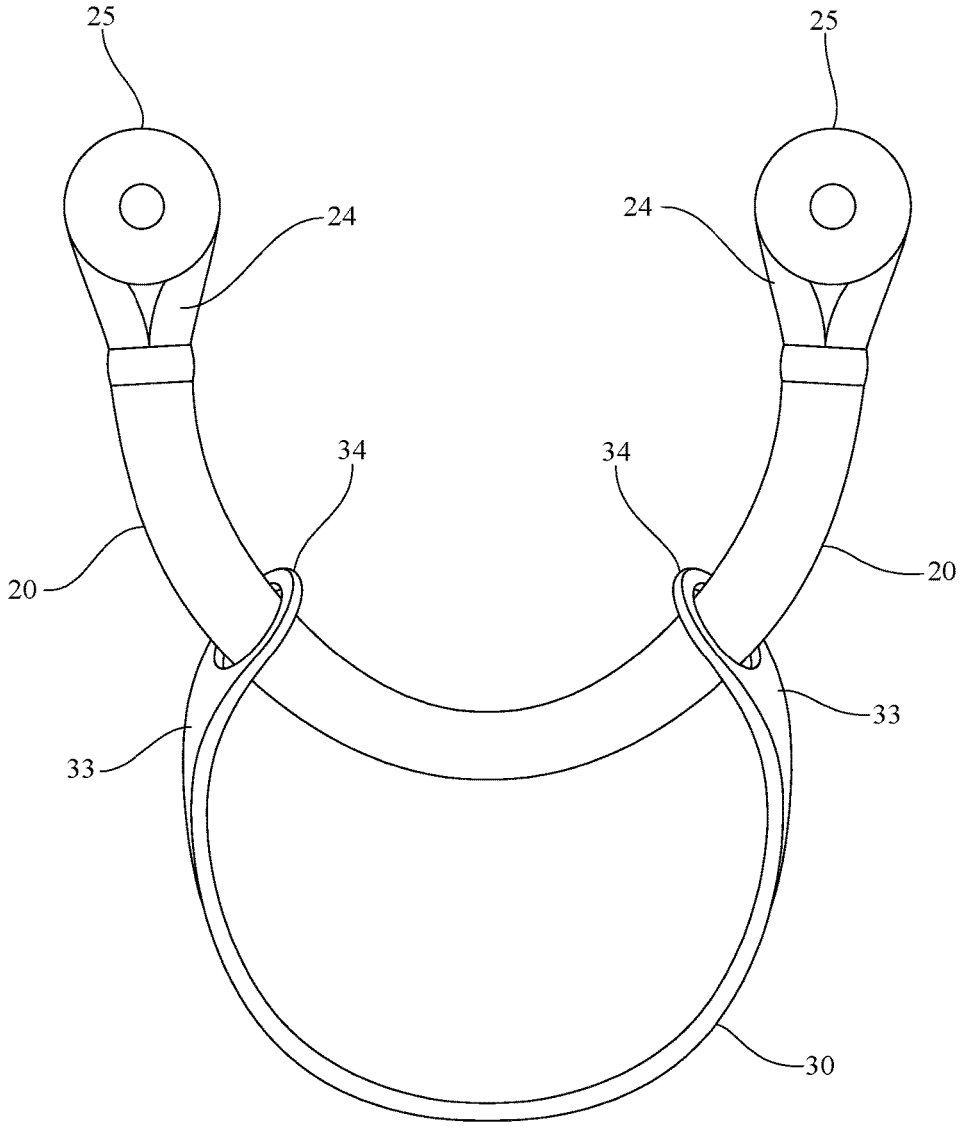
FIG. 2 illustrates the two leash embodiment of the tether of the invention.
Figure 3:
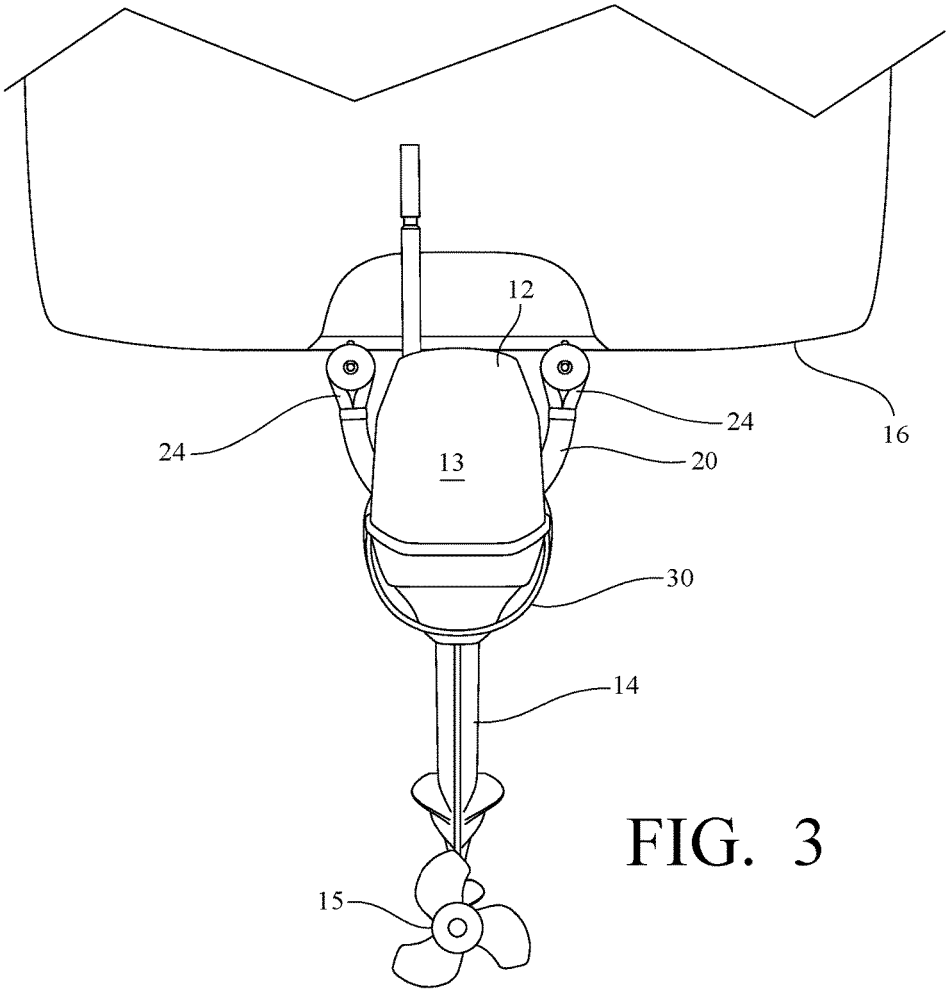
FIG. 3 illustrates the motor tethered by the two leash tether of FIGS. 2.

FIG. 2 and FIG. 3, in which like parts are referenced by like numbers, illustrate another embodiment of the tether of the invention. A secondary leash tether 30 is looped at its free ends 33 to define rings 34. The primary leash tether 20 is passed through the rings 34 so that the ends 33 of the secondary leash tether 30 are slidingly attached to the primary leash tether. In this embodiment the primary leash tether 20 passes around the steering arm assembly 26 which is separate from the exhaust housing 14. The secondary leash tether 30 passes around the exhaust housing 14. The primary leash tether 20 is bolted to the transom 16 of the vessel 10 as described in connection with FIG. 1. The secondary leash tether 22 is constructed of the same materials as the primary leash tether 20 and is the same diameter so that both leash tethers are of extremely high strength.

While the invention has been described in connection with the preferred embodiment it will be understood that the leashes 20 and 30 may comprise any high strength material such as high strength turbostratic carbon fiber, para-aramid synthetic fiber, high strength steel chain and the like.

From the foregoing it will be seen that the present invention provides convenient, readily installed and economical device that can prevent accidental motor flipping due the high speed strikes of the drive section of an outboard motor with a submerged object. With the powerful outboard motors available the danger of such accidents is ever present since submerged objects such as logs and other submerged debris are often present in rivers and lakes.

The invention claimed is:

1. A safety device for outboard motors including a power head, an exhaust housing, a steering arm assembly and a drive section, the safety device being configured to prevent violent motor flipping when the drive section strikes a submerged object, said safety device comprising a primary leash tether defining free ends that are formed about spools, said spools being securely attached to a marine vessel at the transom thereof, or extension from the transom, thereby securing said primary leash tether to said marine vessel, a secondary leash tether having rings formed on the free ends thereof, said primary leash tether extending through said rings thereby to attach said secondary leash tether to said primary leash tether.

2. The safety device of claim 1 wherein said primary leash tether extends around the steering arm assembly of the outboard motor and said secondary leash tether extends around the exhaust housing of the outboard motor.

3. The safety device of claim 1 wherein said primary and secondary leash tethers comprise a rope core having multifilament yarn spun from liquid crystal polyester and a polymeric outer coat.

* * * * *